US011749212B2

(12) United States Patent
Kim et al.

(10) Patent No.: US 11,749,212 B2
(45) Date of Patent: Sep. 5, 2023

(54) DISPLAY DEVICE AND DRIVING METHOD FOR THE SAME

(71) Applicant: LG Display Co., Ltd., Seoul (KR)

(72) Inventors: Daehwan Kim, Paju-si (KR); Jeongho Kang, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/895,061

(22) Filed: Aug. 25, 2022

(65) Prior Publication Data

US 2023/0136867 A1 May 4, 2023

(30) Foreign Application Priority Data

Oct. 28, 2021 (KR) ..... 10-2021-0145340

(51) Int. Cl.
*G09G 3/3291* (2016.01)

(52) U.S. Cl.
CPC ... *G09G 3/3291* (2013.01); *G09G 2310/0272* (2013.01); *G09G 2310/0291* (2013.01); *G09G 2310/08* (2013.01)

(58) Field of Classification Search
CPC ..... G09G 3/3685; G09G 3/3688
See application file for complete search history.

(56) References Cited

U.S. PATENT DOCUMENTS 8,014,055 B2 * 9/2011 Mochizuki ..... G09G 3/3688 359/259
9,275,595 B2 * 3/2016 Kim ..... H03K 5/04
10,354,602 B2 7/2019 Hwang et al.
2008/0129718 A1 * 6/2008 Nishimura ..... H03K 17/122 345/87
2008/0238895 A1 * 10/2008 Lin ..... G09G 3/20 345/204
2009/0058786 A1 * 3/2009 Ku ..... G09G 3/3614 345/96
2009/0058838 A1 * 3/2009 Lee ..... G09G 3/3688 345/204
2012/0306825 A1 * 12/2012 Cho ..... G09G 3/20 345/204

(Continued)

FOREIGN PATENT DOCUMENTS

KR 10-2018-0014406 A 2/2018
KR 10-2019-0012053 A 2/2019

OTHER PUBLICATIONS

N/A.

*Primary Examiner* — Sepehr Azari
(74) *Attorney, Agent, or Firm* — Fenwick & West LLP

(57) ABSTRACT

Disclosed is a display device including: a timing controller outputting image data and a data driving control signal based on an image signal and a control signal inputted from the outside; a data driver outputting a data voltage corresponding to the image data based on the data driving control signal; and a display panel displaying an image corresponding to the data voltage, and the data driver includes: a buffer array where buffer groups, each of which is composed of one or more adjacent output buffers, are disposed; a bias current controller applying a bias current to the buffer groups; and an output circuit sequentially applying the data voltage outputted from the buffer groups to data lines in response to a source output enable signal and driving method for the same.

19 Claims, 8 Drawing Sheets

(56) References Cited

U.S. PATENT DOCUMENTS

| | | | | |
|---|---|---|---|---|
| 2013/0307838 | A1* | 11/2013 | Kim | G09G 5/001 345/212 |
| 2016/0093237 | A1* | 3/2016 | Lee | G09G 3/3688 345/213 |
| 2016/0125821 | A1* | 5/2016 | Lee | G09G 3/3688 345/92 |
| 2016/0171951 | A1* | 6/2016 | Lee | G09G 3/3688 345/204 |
| 2018/0033381 | A1 | 2/2018 | Hwang et al. | |
| 2018/0158408 | A1* | 6/2018 | Chae | G09G 3/3233 |
| 2018/0182278 | A1* | 6/2018 | Kim | G09G 3/2018 |
| 2018/0336860 | A1* | 11/2018 | Xing | G09G 3/3688 |
| 2020/0335027 | A1* | 10/2020 | Kim | G09G 3/20 |
| 2021/0020135 | A1* | 1/2021 | Yang | G11C 7/1057 |
| 2021/0035520 | A1* | 2/2021 | Tsuchi | G02F 1/136286 |
| 2021/0295782 | A1* | 9/2021 | Bae | G09G 3/3283 |
| 2022/0148479 | A1* | 5/2022 | Pyun | G09G 3/3688 |

* cited by examiner

DISPLAY DEVICE AND DRIVING METHOD FOR THE SAME

CROSS REFERENCE TO RELATED APPLICATION

The present application claims priority to Korean Patent Application No. 10-2021-0145340, filed on Oct. 28, 2021, the entire contents of which is incorporated herein for all purposes by this reference.

BACKGROUND

Field

The present disclosure relates to a display device and driving method for the same.

Description of the Related Art

An organic light emitting display device (OLED) is actively used thanks to availability to implement a display device having excellent image quality, lightness, thin shape and low power consumption. The organic light emitting display device applies a data signal to each pixel in synchronization with a gate signal. Pixels emit light at luminance corresponding to a light emission period by charging a voltage corresponding to a data signal. At this time, if a data driver outputs data signals simultaneously, problems such as surging of a peak current or voltage dips may occur because of electrical interference.

To solve the problems, development of technologies to distribute a peak current by grouping output channels of a data driver and delaying data signals per group is underway. However, such technologies may cause luminance decline and deterioration of an image quality since charging time of the most delayed data signal is in shortage in a display device having a short one horizontal period.

SUMMARY

Embodiments provide a display device that sequentially outputs data signals, more specifically, a display device that controls a bias current per buffer group of output buffers and driving method for the same.

Further, the embodiments provide a display device that alternates an order to output data signals of buffer groups in a unit of a frame or a pixel line and driving method for the same.

One embodiment is a display device including: a timing controller outputting image data and a data driving control signal based on an image signal and a control signal inputted from the outside; a data driver outputting a data voltage corresponding to the image data based on the data driving control signal; and a display panel displaying an image corresponding to the data voltage.

The data driver may include a buffer array including a plurality of buffer groups, each of which is comprised of one or more adjacent output buffers; a bias current controller applying a bias current to the buffer groups; and an output circuit sequentially applying the data voltage outputted from the buffer groups to data lines in response to the source output enable signal.

The output circuit may further include a buffer circuit which is disposed between the buffer groups and delays the source output enable signal by a predetermined time; and sequentially delays and outputs the data voltage outputted from the buffer groups in response to the delayed source output enable signal.

The bias current controller may sequentially increase a magnitude of the bias current applied to each of the buffer groups in response to a delay time of the source output enable signal.

The buffer array may include group parties comprised of at least one buffer group, and the bias current controller may control the magnitude of the bias current differently for the group parties.

The group parties may include the same or a different number of buffer groups.

The bias current controller may apply bias current of a default value to the group party comprised of buffer groups having no delay time of the source output enable signal, and may sequentially increase the magnitude of the bias current applied to the group party as a delay time of the source output enable signal increases.

The bias current may be applied to at least one among both sides of the buffer groups and a center of the buffer groups.

The timing controller may transmit, to the bias current controller, a first signal for indicating the number of buffer groups included in the group party, a second signal for indicating the default value of the bias current, and a third signal for indicating a sequential increase amount of the bias current.

The bias current may be applied in a direction of at least one among both sides of the buffer groups and a center of the buffer groups, and the timing controller may alternate an application direction of the source output enable signal in a unit of at least one among the frame and the pixel line.

A delay time of the source output enable signal may alternate in a unit of at least one among the frame and the pixel line in response to the application direction of the source output enable signal.

Another embodiment is a method of controlling the display device including a data driver outputting a data voltage based on a data driving control signal outputted by a timing controller and the method may include applying a bias current to the buffer groups; applying a source output enable signal to the buffer groups by the timing controller; and sequentially applying the data voltage outputted by the buffer groups to data lines, in response to the source output enable signal.

Here, the data driver includes a buffer array including a plurality of buffer groups, each of which is comprised of one or more adjacent output buffers.

The source output enable signal may be sequentially delayed and applied by a buffer circuit disposed between the buffer groups.

The applying the bias current to the buffer groups may include sequentially increasing the magnitude of the bias current applied to each of the buffer groups in response to the delay time of the source output enable signal.

The buffer array may include group parties comprised of at least one buffer group, and the bias current may be controlled differently for the group parties.

The applying the bias current to the buffer groups may include applying a bias current of a default value to the group party comprised of buffer groups having no delay time of the source output enable signal; and sequentially increasing and applying the magnitude of the bias current applied to the group party as a delay time of the source output enable signal increases.

The bias current may be applied to at least one among both sides of the buffer groups and a center of the buffer groups.

The method may further include, before the applying the bias current to the buffer groups, transmitting, to the data driver, a first signal for indicating a number of buffer groups included in the group party, a second signal for indicating the default value of the bias current, and a third signal for indicating sequential increase amount of the bias current.

The applying the bias current to the buffer groups may include: applying, in a first frame, the bias current in a direction from both sides to a center of the buffer groups; applying, in a second frame, the bias current in a direction from a center to both sides of the buffer groups; and applying, in a third frame, the bias current in a direction from both sides to the center of the buffer groups.

The applying the bias current to the buffer groups may include: applying the bias current in a direction from both sides of the buffer groups to a center of the buffer groups in response to a data voltage applied to a first pixel line; applying the bias current in a direction from the center of the buffer groups to both sides of the buffer groups in response to a data voltage applied to a second pixel line; and applying the bias current in the direction from both sides of the buffer groups to a center of the buffer groups in response to a data voltage applied to a third pixel line.

In still another embodiment, a display device comprises a timing controller outputting image data and a data driving control signal based on an image signal and a control signal; a data driver outputting a data voltage corresponding to the image data based on the data driving control signal; and a display panel displaying an image corresponding to the data voltage, wherein the data driver comprises: a buffer array including a first buffer group and a second buffer group, each of the first buffer group and the second buffer group comprised of one or more output buffers; a bias current controller applying a bias current to the buffer groups; and an output circuit including first switching elements and second switching elements applying the data voltage outputted from the buffer groups to data lines in response to a source output enable signal, the source output enable signal being applied to the first switching elements at a first timing and to the second switching elements at a second timing later than the first timing.

In some embodiments, the bias current controller applies a first bias current to the first buffer group and a second bias current to the second buffer group, the second bias current being greater than the first bias current. In other embodiments, in a first frame, the first buffer group is at both sides of the buffer group and the second buffer group is at a center of the buffer group; and in a second frame, the second buffer group is at both sides of the buffer group and the first buffer group is at a center of the buffer group. In still other embodiments, in driving a first pixel line within a frame, the first buffer group is at both sides of the buffer group and the second buffer group is at a center of the buffer group; and in driving a second pixel line within the same frame, the second buffer group is at both sides of the buffer group and the first buffer group is at a center of the buffer group.

DETAILED DESCRIPTION

Figure 1:
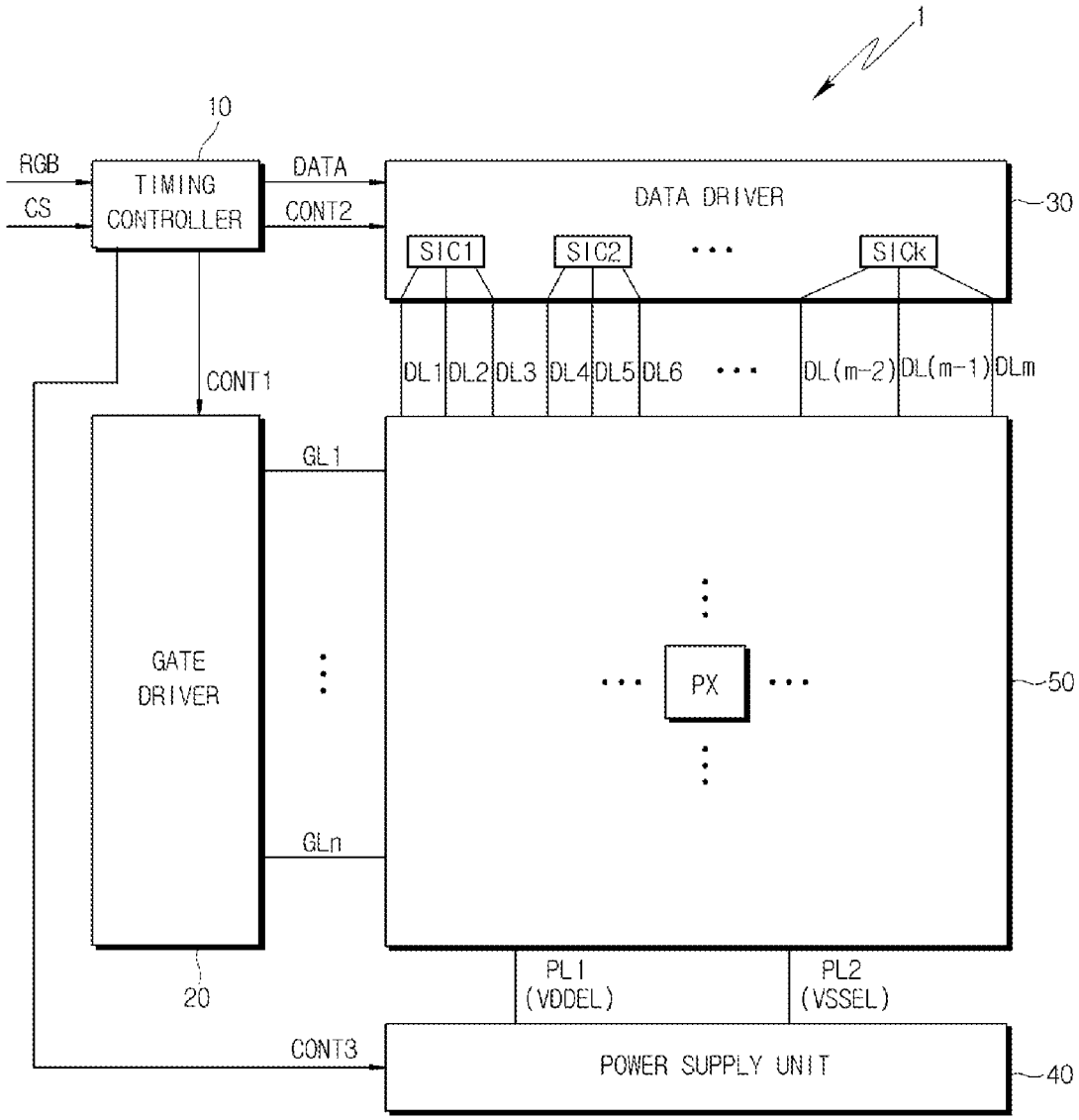
FIG. 1 is a block diagram illustrating configuration of a display device according to an embodiment.

Other details of the embodiments are included in the detailed description and accompanying drawings.

The features, advantages and method for accomplishment of the present invention will be more apparent from referring to the following detailed embodiments described as well as the accompanying drawings. However, the present invention is not limited to the embodiment to be disclosed below and is implemented in different and various forms. In the below description, when a part is referred to as being "connected to" another part, it can be directly connected to the other part, or it can be electrically connected to the other part with another intervening element inserted therebetween. In addition, parts irrelevant to the present disclosure are omitted in the attached drawings for clarity of description, and like reference numerals denote like elements throughout the attached drawings and the written description.

FIG. 1 is a block diagram illustrating configuration of a display device according to an embodiment.

Referring to FIG. 1, a display device 1 includes a timing controller 10, a gate driver 20, a data driver 30, a power supply unit 40 and a display panel 50.

The timing controller 10 may receive an image signal (RGB) and a control signal (CS) from the outside. The image signal (RGB) may include a plurality of grayscale data. The control signal (CS) may include, for example, a horizontal synchronization signal, a vertical synchronization signal and a main clock signal.

One vertical period distinguished by the vertical synchronization signal refers to one frame period required in writing pixel data of one frame into the entire pixels (PX). One horizontal period distinguished by the horizontal synchronization signal refers to a time required in writing pixel data of one pixel line sharing gate lines (GL1~GLn) into the pixels (PX) of one pixel line. In short, one horizontal period is a time of one frame period divided by the n pixel lines.

The timing controller 10 may generate and output an image data (DATA), a gamma control signal (CONT0), a gate driving control signal (CONT1), a data driving control signal (CONT2) and a power supply control signal (CONT3) by processing an image signal (RGB) and a control signal (CS) to be suitable to the operating condition of the display panel 50.

The gate driver 20 may be connected to pixels (or, subpixels, PX) of the display panel 50 through a plurality of gate lines (GL1~GLn). The gate driver 20 may generate gate signals based on the gate driving control signal (CONT1) outputted by the timing controller 10. The gate driver 20 may provide the generated gate signals to pixels (PX) through a plurality of gate lines (GL1~GLn).

The data driver 30 may be connected to the pixels (PX) of the display panel 50 through a plurality of data lines (DL1~DLm). The data driver 30 may generate data signals based on data driving control signal (CONT2) and image data (DATA) outputted by the timing controller 10. The data driver 30 may provide the generated data signals to the pixels (PX) through a plurality of data lines (DL1~DLm). The data signals may be applied to pixels (PX) of a pixel column selected by the gate signal. To this end, the data driver 30 may supply data signals to a plurality of data lines (DL1~DLm) so that the data signals can be synchronized with the gate signal.

The data driver 30 may be configured with one or more source drive ICs (SIC1~SICk) as illustrated in FIG. 1. Each of the source drive ICs (SIC1~SICk) is connected to corresponding data lines (DL1~DLm) and may supply the data signal. The number of the source drive ICs (SIC1~SICk) may be set variously depending on a size, resolution and the like of the display panel 50. The display panel 50 may include a plurality of regions connected to each of the source drive ICs (SIC1~SICk). Each region may output an image based on the data signal outputted from each of the source drive ICs (SIC1~SICk).

The power supply unit 40 may be connected to pixels (PX) of the display panel 50 through a plurality of power lines (PL1, PL2). The power supply unit 40 may generate a driving voltage to be provided to the display panel 50 based on the power supply control signal (CONT3). The driving voltage may include, for example, a high potential driving voltage (VDDEL) and a low potential driving voltage (VSSEL). The power supply unit 40 may provide the generated driving voltages (VDDEL, VSSEL) to the pixels (PX) through corresponding power lines (PL1, PL2).

In the display panel 50, a plurality of pixels (PX)(or, referred to as subpixels) are disposed. The pixels (PX) may be, for example, arranged in a matrix form on the display panel 50.

Each of the pixels (PX) may be electrically connected to the corresponding gate lines and data lines. Such pixels (PX) may emit light at luminance corresponding to the gate signal and the data signal supplied through the gate lines (GL1~GLn) and the data lines (DL1~DLm). For example, the pixels (PX) may receive the data signal during when the gate signal is applied, charge a voltage corresponding to the data signal, and emit light at luminance corresponding to the voltage stored during the light emission period.

Each of the pixels (PX) may display one color among a first to a third color. In the embodiment, each of the pixels (PX) may display one color among red, green and blue. In another embodiment, each of the pixels (PX) may display one color among cyan, magenta and yellow. In various embodiments, pixels (PX) may be configured to display one color among four or more colors. For example, each of the pixels (PX) may display one color among red, green, blue and white.

In FIG. 1, the gate driver 20 and the data driver 30 are illustrated to be separate components from the display panel 50 however, at least one among the gate driver 20 and the data driver 30 may be configured in an In-Panel manner by which a component may be integrated into the display panel 50. For example, the gate driver 20 may be integrated into the display panel 50 in a Gate-In-Panel (GIP) manner.

The timing controller 10, the gate driver 20, the data driver 30 and the power supply unit 40 may be configured as separate Integrated Circuits (IC) or at least some parts thereof together may be integrated into and form the Integrated Circuit. For example, the timing controller 10, the data driver 30 and the power supply unit 40 may be configured as a driving chip in an Integrated Circuit (IC) form. The driving chip may be implemented, for example, as a Flexible Printed Circuit Board (FPCB) form.

Figure 2:
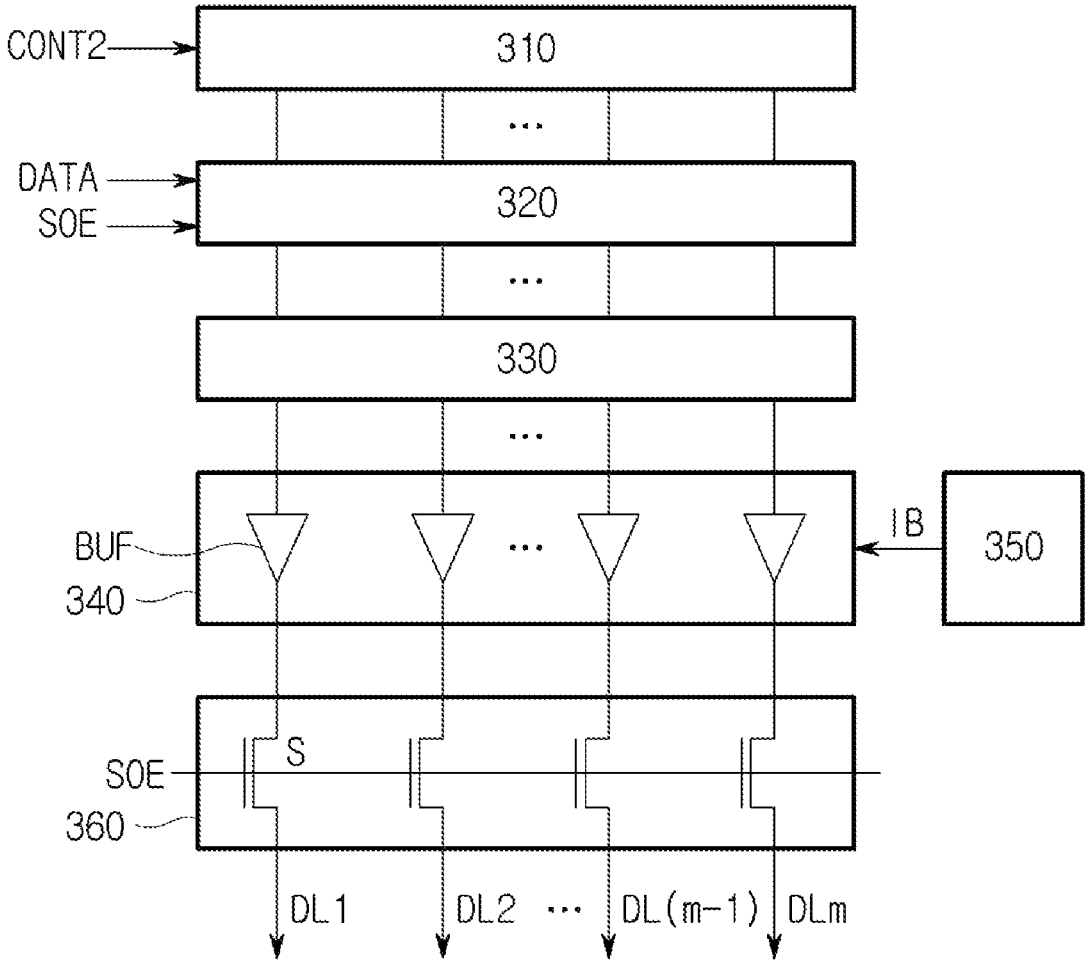
FIG. 2 is a block diagram illustrating configuration of a data drive IC according to an embodiment.

FIG. 2 is a block diagram illustrating configuration of a data drive IC according to an embodiment.

Referring to FIG. 2, a data drive IC (SIC) according to the embodiment may include a register unit 310, a latch unit 320, a digital-analog converter 330, a buffer array 340, a bias current controller 350 and an output circuit 360.

The register unit 310 may generate a sampling signal using the data driving control signal (CONT2) received from the timing controller 10 and provide the generated sampling signal to the latch unit 320.

The latch unit 320 may sample the image data (DATA) received from the timing controller 10 in response to the sampling signal received from the register unit 310. The latch unit 320 may latch the sampled image data of one pixel line amount, output the image data (DATA) of one pixel line amount to the digital-analog converter 330 in response to a source output enable signal (SOE).

The digital-analog converter 330 converts the image data (DATA) received from the latch unit 320 into a gamma compensation voltage and generates a data voltage.

The buffer array 340 may be configured with a plurality of output buffers (BUF) connected one by one to output channels. The output buffers (BUF) output the data voltage outputted from the digital-analog converter 330 to the data lines (DL1~DLm) in response to the source output enable signal (SOE).

The bias current controller 350 may apply a bias current (IB) to the output buffer (BUF). The output buffer (BUF) may amplify the data voltage based on the bias current (IB) delivered by the bias current controller 350 and output the amplified data voltage to the data lines (DL1~DLm).

The output circuit 360 may include a switching element (S) being connected between the output buffer (BUF) and the data lines (DL1~DLm). The switching element (S) is turned on and permits output of the data voltage during a data output period of the source output enable signal (SOE), and is turned off and blocks output of the data voltage during a data blocking period.

Figure 3:
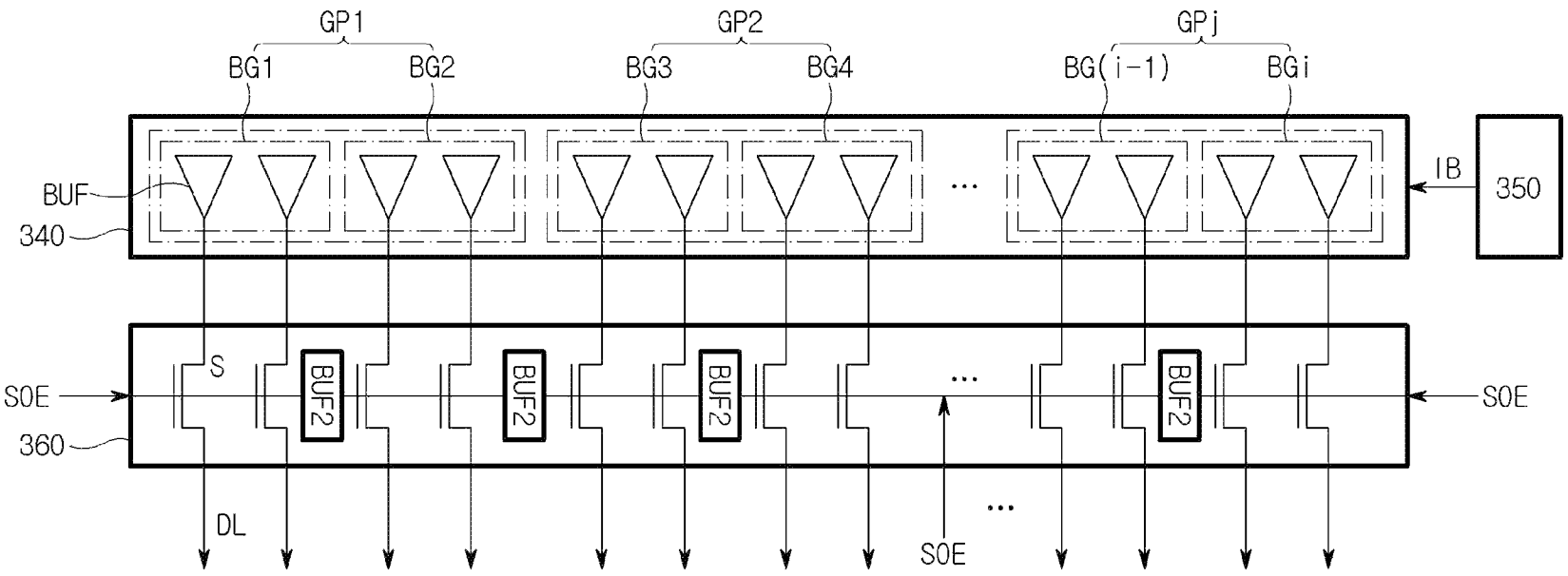
FIG. 3 is a block diagram illustrating a portion of a data driver in more detail according to the first embodiment.
Figure 4:
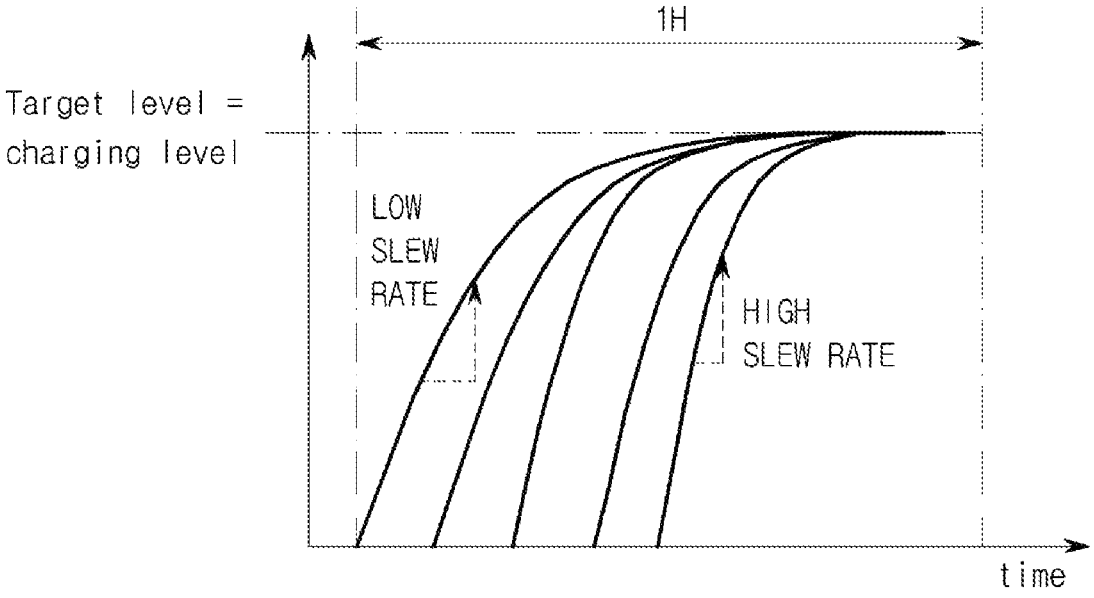
FIG. 4 is a graph illustrating an embodiment of a data signal outputted by output buffer groups.

FIG. 3 is a block diagram illustrating a portion of a data driver in more detail according to the first embodiment. FIG. 4 is a graph illustrating an embodiment of a data signal outputted by output buffer groups.

Referring to FIG. 3, the buffer array 340 may include i buffer groups (BG1~BGi)(i is an arbitrary natural number), each of which is composed of one or more adjacent output buffers (BUF). Hereinafter, embodiments are explained by taking an example of having i as an odd number. However, the embodiments below are not limited thereto, and may be expanded appropriately to a case having i as an even number.

Each of the buffer groups (BG1~BGi) may include the same or a different number of output buffers (BUF). The buffer groups (BG1~BGi) are a set of adjacent output buffers (BUF) that are connected to switching elements (S) that simultaneously receive the source output enable signal (SOE), and are a set of output buffers (BUF) that are connected to switching elements (S) at which a delay in receiving the source output enable signal (SOE) are set to be the same and a delay in outputting the data signal in response to the SOE signal are set to be the same. A method to delay output of the source output enable signal (SOE) and the data signal will be explained in detail below. The output buffers (BUF) included in one buffer group (BG1~Bgi) may be those disposed physically adjacent to each other, but the embodiments are not limited thereto.

The output circuit 360 controls the switching element (S) so that the data voltage can be outputted sequentially from the buffer groups (BG1~BGi). To this end, the output circuit 360 may further include a buffer circuit (BUF2) that is disposed between the buffer groups (BG1~BGi) and delays the source output enable signal (SOE). The buffer circuit (BUF2) is disposed between the adjacent buffer groups (BG1~BGi) in a signal line that receives the source output enable signal (SOE). The source output enable signal (SOE) is delayed by a predetermined time when passing through the buffer circuit (BUF2).

In response to the source output enable signal (SOE), the output circuit 360 turns on the switching element (S) and outputs the data voltage through the switching element (S) that is turned on. When the source output enable signals (SOE) are applied to both sides of the buffer groups (BG1~BGi), the source output enable signals (SOE) are applied first to the output buffers (BUF) of a buffer group 1 (BG1) and a buffer group i (BGi), each of which are disposed at outermost ends of both sides. Then, the switching elements (S) connected to the output buffers (BUF) of the buffer group 1 (BG1) and the buffer group i (BGi) are turned on and a first data voltage is outputted from the output buffers (BUF) of these buffer groups (BG1, BGi).

Thereafter, the source output enable signal (SOE) is applied to the buffer circuit (BUF2). When the source output enable signal (SOE) passes through the buffer circuit (BUF2), the source output enable signal (SOE) is delayed by a certain period of time. Therefore, after a certain period of time passes by since the output of the first data voltage, the source output enable signals (SOE) are applied to a buffer group 2 (BG2) and a group i−1 (BG(i−1)) disposed inwards. Then, the switching elements (S) connected to the buffer group 2 (BG2) and the group i−1 (BG(i−1)) are turned on and a second data voltage is outputted from the output buffers (BUF) of the buffer groups (BG2, BG(i−1)).

In this way, the data voltage may be outputted sequentially from the buffer group 1 (BG1) and the buffer group i (BGi) to the buffer group i/2+1 (BG(i/2+1)). As the data signal is outputted sequentially, electrical interference among the data voltages may be prevented.

The output order of the data voltage is not limited thereto, and may be controlled to be performed in a reverse order of the order described above or in another various orders. For example, when the source output enable signal (SOE) is received from a center of the buffer groups (BG1~BGi), the data signal may be sequentially outputted from the buffer group i/2+1 (BG(i/2+1)) disposed at a center to the buffer group 1 (BG1) and buffer group i (BGi).

In the above embodiment, a pixel (PX) receiving the most delayed data voltage may not sufficiently charge a voltage corresponding to the data voltage due to lack of the charging time. Then, the pixel (PX) may not emit light sufficiently at a required luminance and as a result luminance decline and image quality deterioration may occur.

To prevent such problems, the bias current controller 350 may control a magnitude of the bias current (IB) provided to the buffer groups (BG1~BGi) differently corresponding to an output delay time of the data voltage, in other words, a delay time of the source output enable signal (SOE). The bias current (IB) controls a magnitude of an output current being provided to the output buffer (BUF) and outputted from the output buffer (BUF). When an output current of the output buffer (BUF) increases, a change amount of the data voltage outputted from the output buffer (BUF), in other words, a slew rate increases. To the contrary, when an output current of the output buffer (BUF) decreases, a slew rate of the data voltage outputted from the output buffer (BUF) decreases.

A change in the data voltage according to differences in the slew rate is the same as the illustration in FIG. 4. When the slew rate increases, a change amount of a voltage during a unit time increases, and a targeted value (Target level=Charging level) of the data voltage may be reached for a period of time shorter than the period of a case having a lower slew rate. Therefore, by controlling a magnitude of the bias current (IB) of the buffer groups (BG1~BGi) having no output delay or a shorter output delay of the data voltage to a default value, and increasing a magnitude of the bias current (IB) of the buffer groups (BG1~BGi) having a longer output delay of the data voltage, it is possible to secure sufficient charging time of the data voltage and to prevent lack of uniformity in luminance, while preventing electrical interference among buffer groups (BG1~BGi).

In the embodiment, the bias current controller 350 may provide the bias current (IB) of a different magnitude to each of the buffer groups (BG1~BGi) having different output delays of the data voltage at the corresponding switching elements (S) connected to each of the buffer groups (BG1~BGi). In another embodiment, the bias current controller 350 may provide the bias current (IB) of the same magnitude to two or more buffer groups (BG1~BGi) having different output delays of the data voltage at the corresponding switching elements (S) connected to each of the buffer groups (BG1~BGi). For example, the bias current controller 350 may provide the bias current (IB) of the same magnitude to two or more adjacent buffer groups. The buffer groups provided with the bias current (IB) of the same magnitude may be referred to as a group party (GP1~GPj). The buffer groups included in the same group party may be those disposed physically adjacent with each other, but the embodiments are not limited thereto.

Each of the group party (GP1~GPj) may include the same or a different number of buffer groups. For example, group parties 1 to j−1 (GP1~GP(j−1)) include the same number of buffer groups, and a group party j (GPj) may include the same or fewer number of buffer groups than the group parties 1 to j−1 (GP1~GP(j−1)). However the embodiment is not limited thereto. The number of buffer groups (BG1~BGi) included in one group party (GP1~GPj) may be variously indicated by the driving control signal (CONT2) transmitted by the timing controller 10.

In the embodiment, the driving control signal (CONT2) may include a Party-Step signal (a first signal) aimed at indicating the number of buffer groups to receive the same bias current (IB). Party_Step signal may indicate the number of buffer groups (BG1~BGi) to be included in one group party (GP1~GPj) as a binary value by using x bit. For example, when Party_Step signal is set to 3 bit and the bias current (IB) of the same magnitude is applied to two buffer groups, Party_step signal may be set as "LHL". The bias current controller 350 may allocate three buffer groups to one group party and supply the same magnitude of a bias current (IB) to three adjacent buffer groups in response to the Party_Step signal.

The magnitude of the bias current (IB) being applied to the buffer groups (BG1~BGi) may be indicated by the driving control signal (CONT2) transmitted by the timing controller 10. In the embodiment, the driving control signal (CONT2) may include a PWRC signal (second signal) aimed at indicating a default value of the bias current (IB) and a PWRC_Step signal (third signal) aimed at indicating a sequential change amount (increase amount) of the bias current (IB). The PWRC signal may indicate a default value of the bias current (IB) as a binary value by using y bit. For example, when the PWRC signal is set to 5 bit and the default value of the bias current (IB) is set to 2, the PWRC signal may be set as "LLLHL". The PWRC_Step signal may indicate a change amount of the bias current (IB) changed among adjacent group parties (GP1~GPj) by using z bit. For example, when the PWRC_Step signal is set to 5 bit and the change amount of the bias current (IB) is 2, the PWRC_Step signal may be set as "HL". Here, a unit of the bias current (IB) may be mA, but is not limited thereto.

In response to the PWRC signal and the PWRC_Step signal, the bias current controller 350 may apply 10 mA bias current (IB) to a random group party, and sequentially increase and apply the bias current (IB) by 2 mA to adjacent group parties. For example, the bias current controller 350 may apply the bias current (IB) of a default value to the group party 1 and group party j (GP1, GPj) each having no output delay of data signals and apply the bias current (IB) bigger than the default value by as much as a predetermined change amount to a group party 2 and a group party j−1 (GP2, j−1 not illustrated) of which an output delay of the data signal increase. In addition, corresponding to the increase of an output delay of the data signal, the bias current controller 350 may apply the bias current (IB) bigger than the default value by twice as big as the predetermined change amount to a group party 3 and group party j−2 (not illustrated), and apply the bias current (IB) bigger than the default value by three times as big as the predetermined change amount to a group parties 4 and j−3 (not illustrated).

In such ways, the bias current controller 350 may control a magnitude of the bias current (IB) for the group parties (BP1~BPj) and adjust the slew rate of the data signal. An increasing order of the bias current (IB) is not limited thereto, and the bias current (IB) may be variously controlled depending on a size of an output delay of the data signal.

In the embodiment, the bias current controller 350 may include independent bias blocks in order to apply the bias current (IB) to each of group parties (GP1~GPj). The number of bias blocks may be determined depending on the number of magnitudes of the bias current (IB) being applied to the buffer groups (BG1~BGi), but is not limited thereto, and may be determined depending on various conditions of the display device 1 such as sizes, purposes, functions, specifications and the like.

Figure 5:
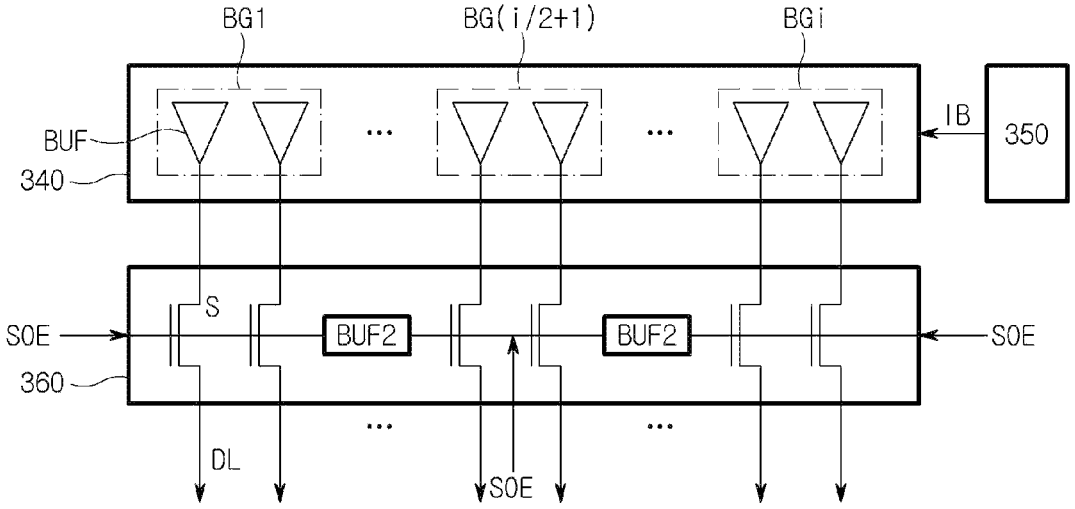
FIG. 5 is a block diagram illustrating a portion of a data driver in more detail according to the second embodiment.
Figure 6:
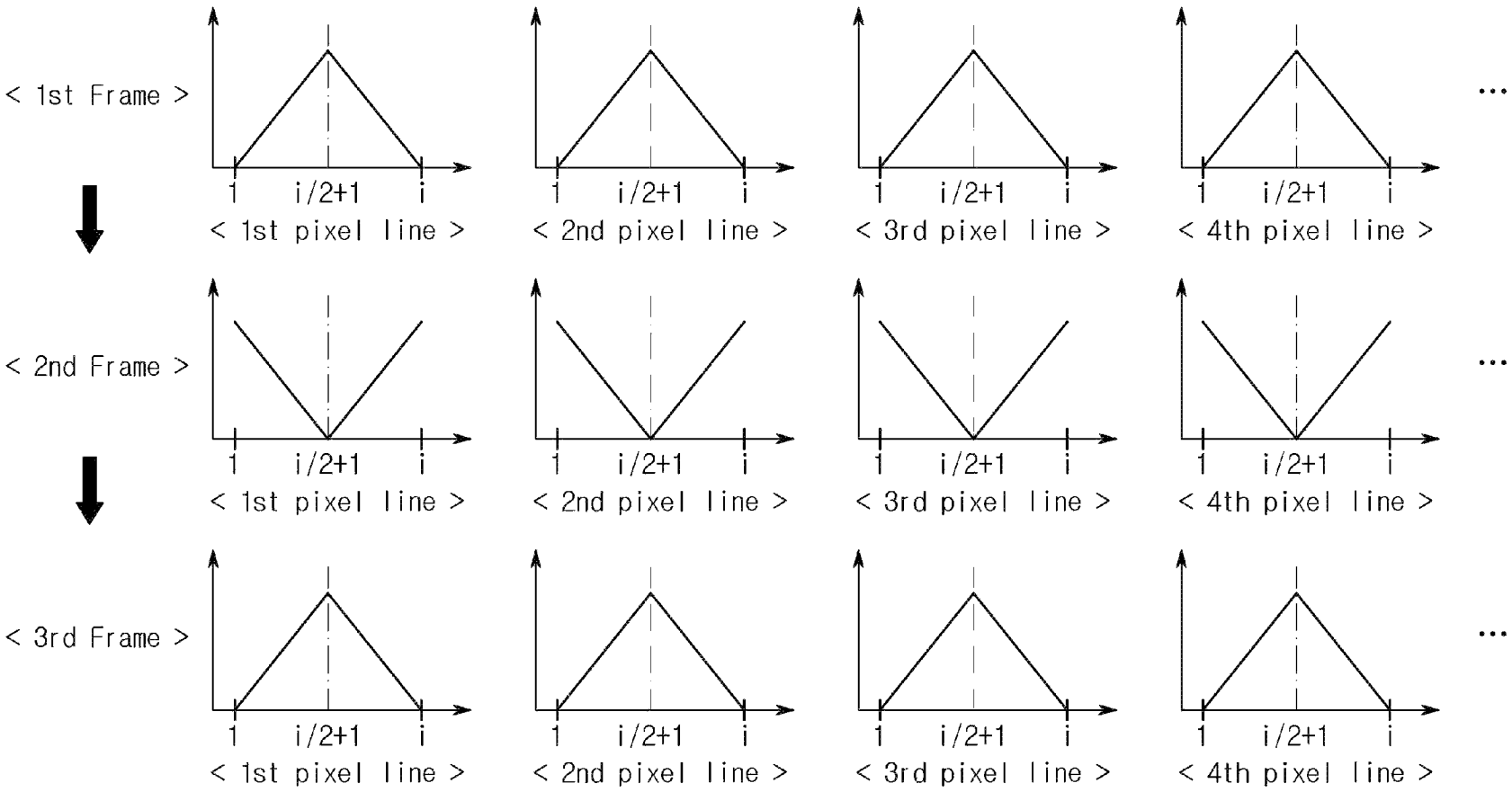
FIG. 6 is a graph illustrating a delay time of a source output enable signal applied to source output buffer groups according to an embodiment.
Figure 7:
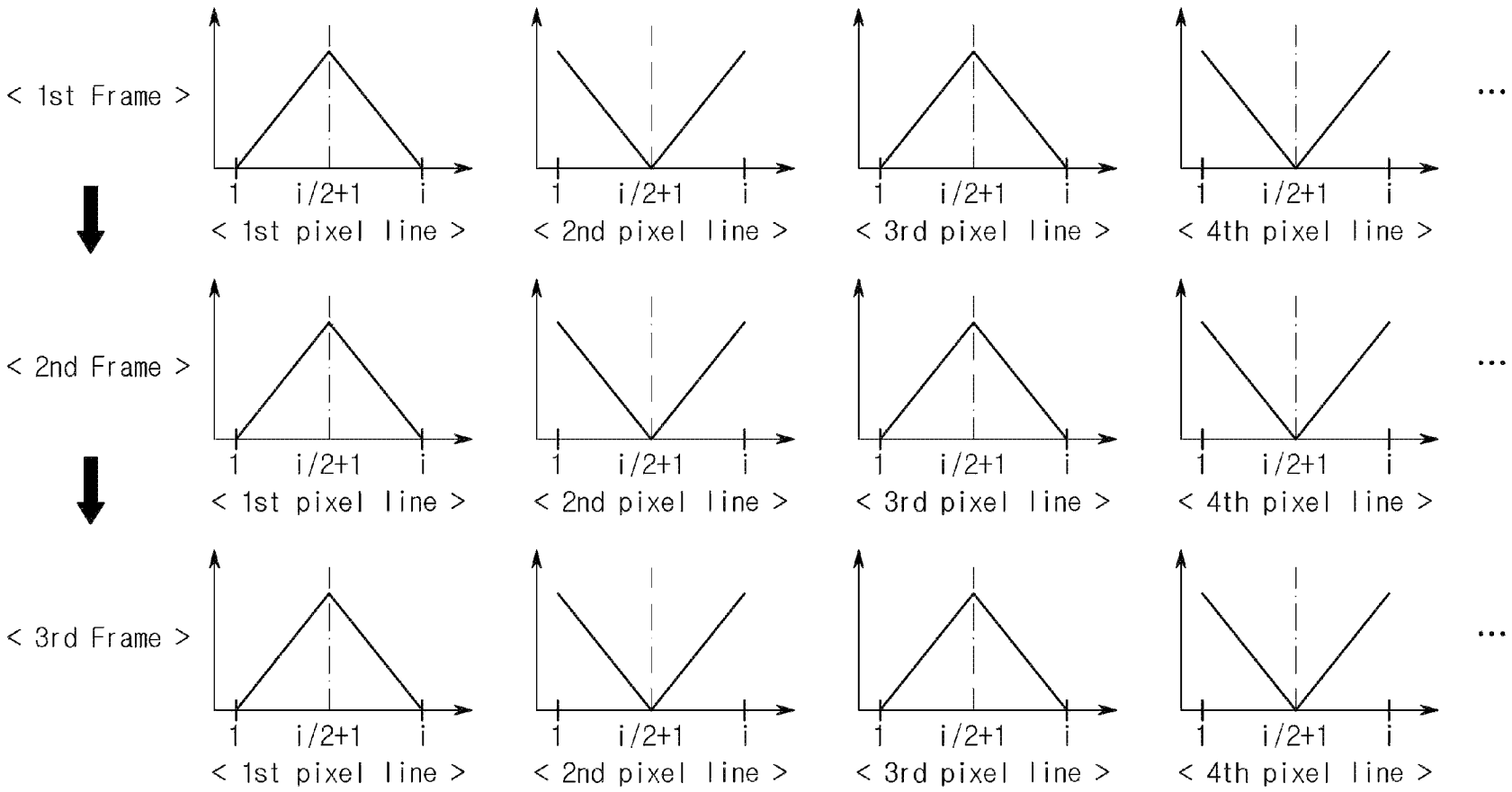
FIG. 7 is a graph illustrating a delay time of a source output enable signal applied to source output buffer groups according to another embodiment.
Figure 8:
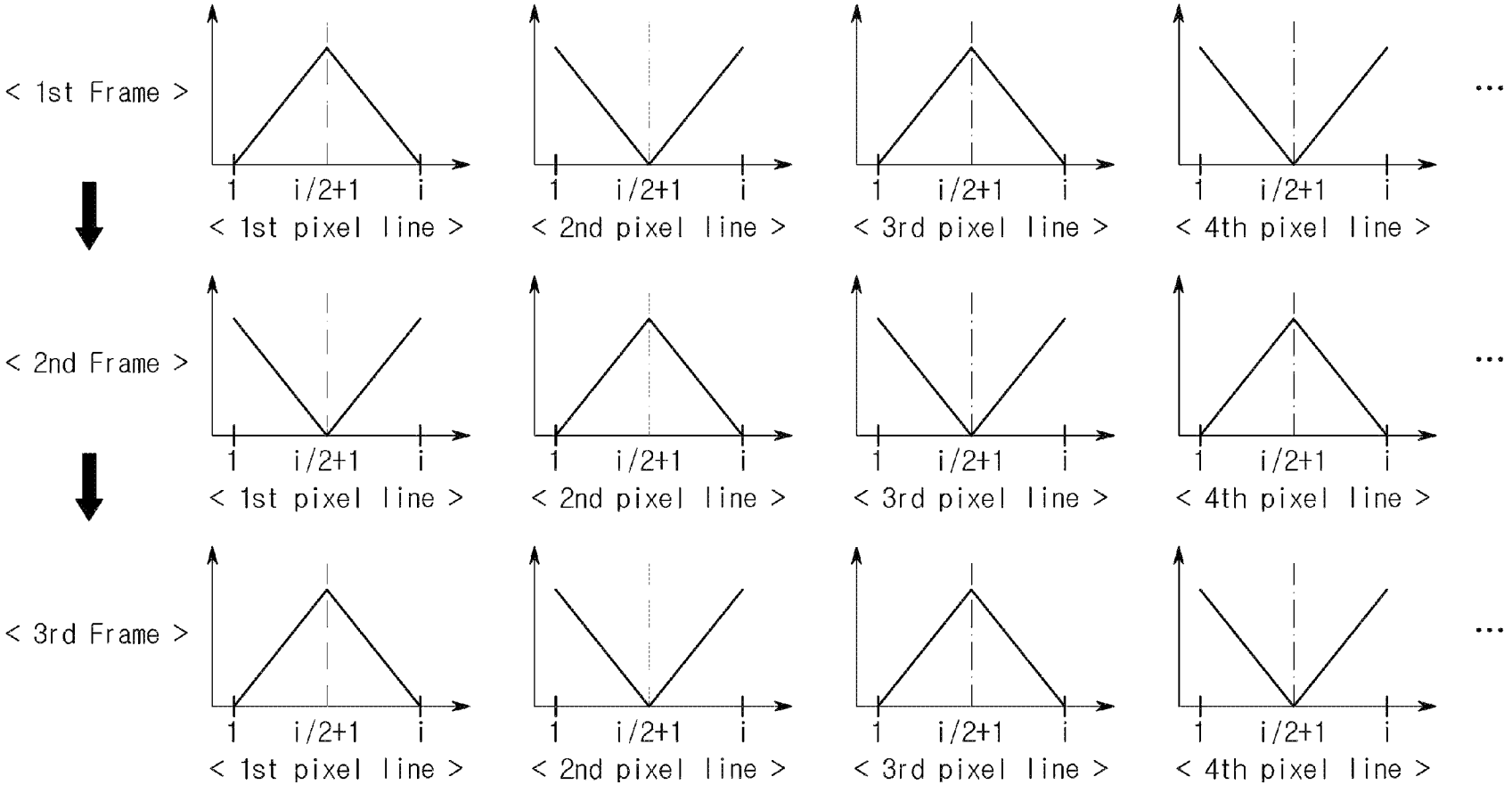
FIG. 8 is a graph illustrating a delay time of a source output enable signal applied to source output buffer groups according to still another embodiment.

FIG. 5 is a block diagram illustrating a portion of a data driver in more detail according to the second embodiment. FIG. 6 is a graph illustrating a delay time of a source output enable signal applied to source output buffer groups according to an embodiment. FIG. 7 is a graph illustrating a delay time of a source output enable signal applied to source output buffer groups according to another embodiment. FIG. 8 is a graph illustrating a delay time of a source output enable signal applied to source output buffer groups according to still another embodiment.

Referring to FIG. 5, the buffer array 340 may include i buffer groups (BG1~BGi)(i is an arbitrary natural number), each of which is composed of one or more adjacent output buffers (BUF). Each of the buffer groups (BG1~BGi) may include the same or a different number of output buffers (BUF). The buffer groups (BG1~BGi) are a set of adjacent output buffers (BUF) that are connected to switching elements (S) at which a delay in outputting the data signal is set to be the same, and a method to delay an output of the data signal will be explained in detail below. The output buffers (BUF) included in one buffer group (BG1~BGi) may be the output buffers disposed adjacent to each other, but the embodiments are not limited thereto.

The output circuit 360 makes the data voltage be sequentially outputted from the buffer groups (BG1~BGi) by controlling the switching element (S). The output circuit 360 may cause the buffer groups (BG1~BGi) to have sequential delays in outputting the data voltage and may prevent the electrical interference occurring between the data signals.

In the above embodiment, a pixel (PX) receiving the most delayed data voltage may not sufficiently charge a voltage corresponding to the data voltage due to lack of the charging time. Then, the pixel (PX) may not emit light at a required luminance and problems of luminance decline and image quality deterioration may occur.

To prevent such problems, the output circuit 360 may alternate the output order of the data signal in a unit of a frame and a pixel line.

In the embodiment, the timing controller 10 and the output circuit 360 may alternate the application direction (delay order) of the source output enable signal (SOE) and the consequent output order of the data signal in a unit of a frame as illustrated in FIG. 6.

Specifically, the source output enable signal (SOE) may be applied to both sides of the buffer groups (BG1~BGi) during the first frame. Then, in response to the source output enable signal (SOE), the output circuit 360 may output the data signal sequentially from the buffer group 1 (BG1) and the buffer group i (BGi) to the buffer group i/2+1 (BG(i/2+1)).

Thereafter, during the second frame, the source output enable signal (SOE) may be applied to the center of the buffer groups (BG1~BGi). Then, in response to the source output enable signal (SOE), the output circuit 360 may output the data signal sequentially from the buffer group i/2+1 (BG(i/2+1)) to the buffer group 1 (BG1) and the buffer group i (BGi).

Thereafter, during the third frame, the source output enable signal (SOE) may be applied to both sides of the buffer groups (BG1~BGi) again.

In another embodiment, the timing controller 10 and the output circuit 360 may alternate the application direction (delay order) of the source output enable signal (SOE) and the consequent output order of the data signal in a unit of a pixel line as illustrated in FIG. 7.

Specifically, the source output enable signal (SOE) may be applied to both sides of the buffer groups (PG1~PGi) in response to the data voltage being applied to the first pixel line. Then, in response to the source output enable signal (SOE), the output circuit 360 may sequentially output the data voltage being applied to the first pixel line from the buffer group 1 (BG1) and the buffer group i (BGi) to the buffer group i/2 (BG(i/2)) and the buffer group i/2+1 (BG(i/2+1)).

Further, the source output enable signal (SOE) may be applied to a center of the buffer groups (PG1~Pgi) in response to the data voltage being applied to the second pixel line. Then, in response to the source output enable signal (SOE), the output circuit 360 may sequentially output the data voltage being applied to the second pixel line from the buffer group i/2 (BG(i/2)) and buffer group i/2+1 (BG(i/2+1)) to the buffer group 1 (BG1) and the buffer group i (BGi).

The source output enable signal (SOE) may be applied to both sides of the buffer groups (PG1~PGi) in response to the data voltage being applied to the third pixel line.

In such ways, the output order of the data signal of the buffer groups (PG1~PGi) may be alternated in a unit of a pixel line. In such an embodiment, the pixel (PX) receiving the most delayed data voltage may have luminance decline due to lack of charging time, however, a location of a pixel (PX) having luminance decline changes per frame, therefore deterioration in the display quality may not be recognized to a user's eye.

In still another embodiment, the timing controller 10 and the output circuit 360 may alternate the application direction of the source output enable signal (SOE) and the consequent output order of the data signal in a unit of a frame and pixel line as illustrated in FIG. 8.

In such ways, the output order of the data signal of the buffer groups (PG1~PGi) may be alternated in a unit of a frame and/or a pixel line. In such an embodiment, a pixel (PX) receiving the most delayed data voltage may have luminance decline due to lack of charging time, however, a location of a pixel (PX) having luminance decline changes per frame, therefore deterioration in the display quality may not be recognized to a user's eye.

The display device and driving method for the same according to embodiments may make output voltages of the entire data signals reach a targeted level by sufficiently securing charging time of data signals, thereby preventing luminance decline of a display panel.

Further, the display device and driving method for the same according to embodiments may make uniform luminance over the entire areas of a display panel.

Those skilled in the art may understand that the present disclosure described herein may be implemented in other concrete forms without departing from the technical concept or essential features thereof. Thus, it should be understood that embodiments described hereinabove are examples in all aspects, and do not limit the present disclosure. The scope of the present disclosure will be denoted by the claims that are provided hereinbelow, rather than the detailed description. In addition, it should be construed that all modifications or variations that are derived from the meaning, scope and the concept of equivalence of the claims are covered in the scope of the present disclosure.

What is claimed is:

1. A display device comprising:

a timing controller outputting image data and a data driving control signal based on an image signal and a control signal;

a data driver outputting a data voltage corresponding to the image data based on the data driving control signal; and a display panel displaying an image corresponding to the data voltage, wherein the data driver comprises:

a buffer array including a plurality of buffer groups, each of which is comprised of one or more adjacent output buffers;

a bias current controller applying a bias current to the buffer groups; and an output circuit sequentially applying the data voltage outputted from the buffer groups to data lines, in response to a source output enable signal, and wherein the output circuit further comprises a buffer circuit which is disposed between the buffer groups and delays the source output enable signal by a predetermined time, and sequentially delays and outputs the data voltage outputted from the buffer groups, in response to the delayed source output enable signal.

2. The display device of claim 1, wherein the bias current controller sequentially increases a magnitude of the bias current applied to each of the buffer groups in response to a delay time of the source output enable signal.

3. The display device of claim 2, wherein the buffer array comprises group parties comprised of at least one buffer group, and wherein the bias current controller controls the magnitude of the bias current differently for the group parties.

4. The display device of claim 3, wherein the bias current controller applies a bias current of a default value to a group party comprised of buffer groups having no delay time of the source output enable signal, and sequentially increases the magnitude of the bias current applied to the group party as the delay time of the source output enable signal increases.

5. The display device of claim 4, wherein the bias current is applied to at least one among both sides of the buffer groups and a center of the buffer groups.

6. The display device of claim 4, wherein the timing controller transmits, to the bias current controller, a first signal for indicating the number of buffer groups comprised in the group party, a second signal for indicating the default value of the bias current, and a third signal for indicating a sequential increase amount of the bias current.

7. The display device of claim 1, wherein the bias current is applied in a direction of at least one among both sides of the buffer groups and a center of the buffer groups, and wherein the timing controller alternates an application direction of the source output enable signal in a unit of at least one among a frame and a pixel line.

8. The display device of claim 7, wherein a delay time of the source output enable signal alternates in a unit of at least one among the frame and the pixel line in response to the application direction of the source output enable signal.

9. A method of controlling a display device comprising a data driver outputting a data voltage based on a data driving control signal outputted by a timing controller, wherein the data driver comprises a buffer array including a plurality of buffer groups, each of which is comprised of one or more adjacent output buffers; and wherein the method comprises:

applying a bias current to the buffer groups;

applying a source output enable signal to the buffer groups by the timing controller; and sequentially applying the data voltage outputted from the buffer groups to data lines, in response to the source output enable signal, and wherein the source output enable signal is sequentially delayed and applied to the buffer groups by a buffer circuit disposed between the buffer groups.

10. The method of claim 9, wherein the applying the bias current to the buffer groups comprises sequentially increasing a magnitude of the bias current applied to each of the buffer groups in response to a delay time of the source output enable signal.

11. The method of claim 10, wherein the buffer array comprises group parties comprised of at least one buffer group, and wherein the bias current is controlled differently for the group parties.

12. The method of claim 11, wherein the applying the bias current to the buffer groups comprises:

applying a bias current of a default value to the group party comprised of buffer groups having no delay time of the source output enable signal; and sequentially increasing and applying the magnitude of the bias current applied to the group party as the delay time of the source output enable signal increases.

13. The method of claim 11, further comprising: before the applying the bias current to the buffer groups, transmitting, to the data driver, a first signal for the timing controller to indicate the number of buffer groups comprised in the group party, a second signal for the timing controller to indicate the default value of the bias current, and a third signal for the timing controller to indicate a sequential increase amount of the bias current.

14. The method of claim 9, wherein the applying the bias current to the buffer groups comprises:

applying, in a first frame, the bias current in a direction from both sides of the buffer groups to a center of the buffer groups;

applying, in a second frame, the bias current in a direction from the center of the buffer groups to both sides of the buffer groups; and applying, in a third frame, the bias current in the direction from both sides of the buffer groups to the center of the buffer groups.

15. The method of claim 9, wherein the applying the bias current to the buffer groups comprises:

applying the bias current in a direction from both sides of the buffer groups to a center of the buffer groups in response to a data voltage applied to a first pixel line;

applying the bias current in a direction from the center of the buffer groups to both sides of the buffer groups in response to a data voltage applied to a second pixel line; and applying the bias current in the direction from both sides of the buffer groups to the center of the buffer groups in response to a data voltage applied to a third pixel line.

16. A display device comprising:

a timing controller outputting image data and a data driving control signal based on an image signal and a control signal;

a data driver outputting a data voltage corresponding to the image data based on the data driving control signal; and a display panel displaying an image corresponding to the data voltage, wherein the data driver comprises:

a buffer array including a first buffer group and a second buffer group, each of the first buffer group and the second buffer group comprised of one or more output buffers;

a bias current controller applying a bias current to the buffer groups; and an output circuit including first switching elements and second switching elements applying the data voltage outputted from the buffer groups to data lines in response to a source output enable signal, the source output enable signal being applied to the first switching elements at a first timing and to the second switching elements at a second timing later than the first timing.

17. The display device of claim 16, wherein the bias current controller applies a first bias current to the first buffer group and a second bias current to the second buffer group, the second bias current being greater than the first bias current.

18. The display device of claim 16, wherein:

in a first frame, the first buffer group is at both sides of the buffer group and the second buffer group is at a center of the buffer group; and in a second frame, the second buffer group is at both sides of the buffer group and the first buffer group is at a center of the buffer group.

19. The display device of claim 16, wherein:

in driving a first pixel line within a frame, the first buffer group is at both sides of the buffer group and the second buffer group is at a center of the buffer group; and in driving a second pixel line within the same frame, the second buffer group is at both sides of the buffer group and the first buffer group is at a center of the buffer group.

* * * * *